US009261249B2

(12) United States Patent
Cheng

(10) Patent No.: US 9,261,249 B2
(45) Date of Patent: Feb. 16, 2016

(54) MULTI-LAMP DECORATING CURTAIN LIGHT

(71) Applicant: Hung-Huei Cheng, Hsinchu (TW)

(72) Inventor: Hung-Huei Cheng, Hsinchu (TW)

( * ) Notice: Subject to any disclaimer, the term of this patent is extended or adjusted under 35 U.S.C. 154(b) by 39 days.

(21) Appl. No.: 14/166,871

(22) Filed: Jan. 29, 2014

(65) Prior Publication Data

US 2015/0211696 A1 Jul. 30, 2015

(51) Int. Cl.
*F21S 4/00* (2006.01)
*F21W 121/00* (2006.01)

(52) U.S. Cl.
CPC ..... *F21S 4/001* (2013.01); *F21W 2121/00* (2013.01)

(58) Field of Classification Search
CPC . F21S 4/002; F21W 2121/00; F21Y 2111/00; H05B 39/00
USPC ..... 362/249
See application file for complete search history.

(56) References Cited

U.S. PATENT DOCUMENTS

| | | | | |
|---|---|---|---|---|
| 4,228,486 | A * | 10/1980 | Matsuya | 362/237 |
| 5,860,731 | A * | 1/1999 | Martinez | 362/249.16 |
| 5,915,827 | A * | 6/1999 | Wang | 362/391 |
| 6,217,193 | B1 * | 4/2001 | Won | 362/249.16 |
| 7,063,442 | B2 * | 6/2006 | Sugar | 362/249.16 |
| 2004/0080281 | A1 * | 4/2004 | Pan | 315/185 S |

* cited by examiner

*Primary Examiner* — Mary Ellen Bowman
(74) *Attorney, Agent, or Firm* — Leong C. Lei

(57) ABSTRACT

The present invention is related to a multi-lamp decorating curtain light with a split string having illuminating elements each of which is assembled by two or more decorating lamps into one illuminating element by means of wire winding when connecting the wire of the split string with the decorating lamps. Thereby each illuminating element on each split string is in a cluster format constituted by the multiply decorating lamps in order to achieve the better decorating effectiveness by the enhanced flashing mode.

2 Claims, 2 Drawing Sheets

MULTI-LAMP DECORATING CURTAIN LIGHT

TECHNICAL FIELD OF THE INVENTION

The present invention is related to an improvement on the structure of a decorating light, particularly an improvement on a split string of a decorating curtain light.

DESCRIPTION OF THE PRIOR ART

The structure of an ordinary decorating curtain light includes a stem wire and a plurality of split strings provided on the stem wire in parallel arrangement so as to constitute a format of curtain light. The split string of the decorating curtain light of the prior art is an extension wire on which a plurality of decorating lamps is assembled at a set interval distance in order to achieve the flashing mode. However, the split strings of the decorating curtain light of the prior art has a single decorating lamp as one illuminating element from which the light illuminated can only achieve relatively inadequate decorating effectiveness.

According to the deficiency of decorating light of the prior art, the inventor of the present invention previously worked out an improvement with a patent application granted with approval of U.S. Pat. No. 6,445,136. The inventor worked on continuous improvement resulting in a multi-lamp decorating curtain light of the present invention with further advantage in economic and utility.

SUMMARY OF THE INVENTION

An objective of the present invention is to provide a multi-lamp decorating curtain light to assemble two or more decorating lamps into one illuminating element by means of wire winding when connecting a wire with the decorating lamps so as to make each illuminating element on a split string in a cluster format constituted by the multiply decorating lamps in order to achieve the better decorating effectiveness by the enhanced flashing mode.

DETAILED DESCRIPTION OF THE PREFERRED EMBODIMENTS

Figure 1:
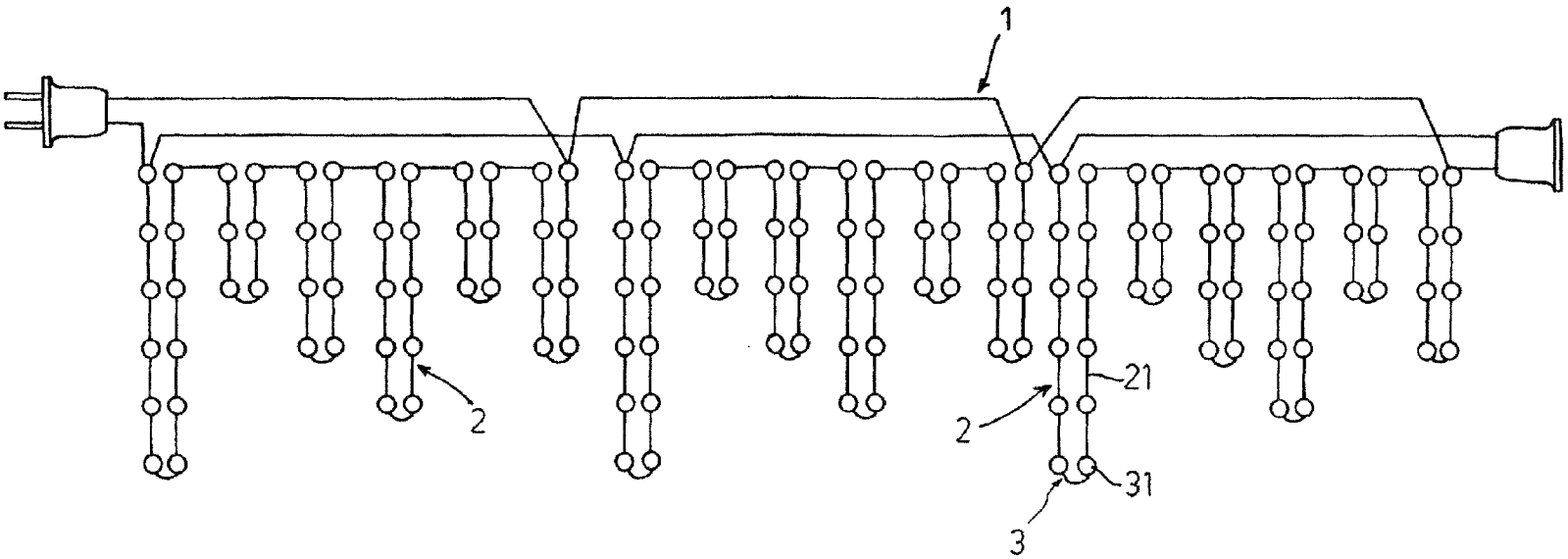
FIG. 1 is a schematic diagram illustrating the arrangement of the present invention.
Figure 2:
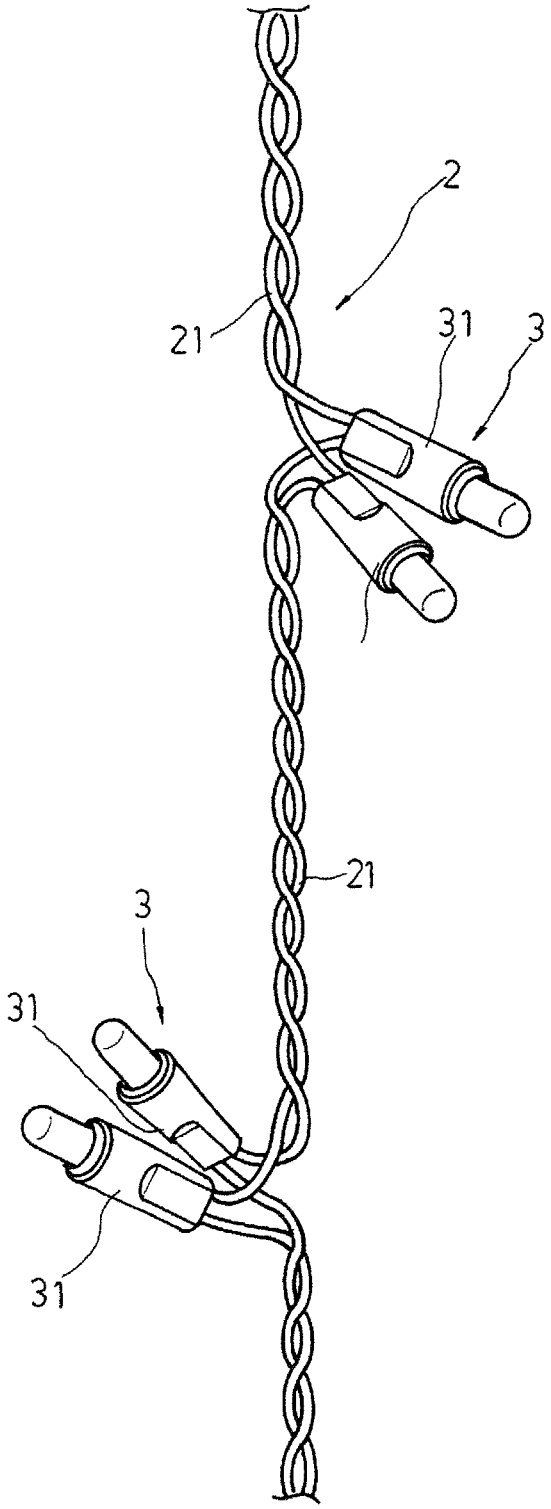
FIG. 2 is three-dimensional diagram illustrating a partial structure of the present invention.

Please refer FIGS. 1 and 2. A multi-lamp decorating curtain light of the present invention includes a stem wire (1) and a plurality of split strings (2), which are made of downward extension wires (21) in parallel arrangement, provided on the stem wire (1) in order to constitute a curtain format. The split string (2) is the extension wire (21) and a plurality of illuminating elements (3) provided at a set interval distance with improvement as characterized that each of the illuminating elements (3) on the split string (2) is an assembly of two decorating lamps (31) by means of wire winding into one illuminating element (3) when connecting the extension wire (21) with the decorating lamps (31). Thereby each of the illuminating elements (3) on the split string (2) is in a cluster format constituted by the multiply decorating lamps.

Through the above-mentioned, each illuminating element on the split string of the present invention achieves a flashing mode of dual decorating lamps resulting in better decorating effectiveness that is beyond the prior art. Further the unprecedented design for constituting the illuminating elements already complies with the novelty and utility for a patent.

I claim:

1. A multi-lamp decorating curtain light comprising a curtain format comprising a single stem wire and illuminating elements arranged in series and electrically connected to the stem wire, the stem wire being divided into a plurality of sections each of which is folded in a bisected manner with first and second halves of the section twisted with each other, the first and second halves of the section including a predetermined number of the illuminating elements with each of the illuminating elements of the first half corresponding to and paired with each of the illuminating elements of the second half to form a cluster so that the twisted first and second halves of the section of the stem wire and the paired illuminating elements thereof collectively define a string, and the plurality of sections of the stem wire define a plurality of split strings connected in series to each other, said split strings being in a parallel spatial arrangement and depending from the stem wire to define the curtain format, the illuminating elements provided on each of said plurality of split strings at a set interval distance, each of said split strings comprising multiple clusters that are spaced from each other.

2. The multi-lamp decorating curtain light of claim 1, wherein each of the multiple clusters of each of said plurality of split strings comprises two illuminating elements arranged together.

* * * * *